US006508288B2

(12) United States Patent
Lenhof et al.

(10) Patent No.: US 6,508,288 B2
(45) Date of Patent: Jan. 21, 2003

(54) APPARATUS FOR ASSEMBLING A SHAFT TO A GOLF CLUB HEAD

(75) Inventors: Konrad Lenhof, Vista, CA (US); Jerry V. Blanke, Murrietta, CA (US); Paul D. Zanolli, Valley Center, CA (US)

(73) Assignee: Callaway Golf Company, Carlsbd, CA (US)

( * ) Notice: Subject to any disclaimer, the term of this patent is extended or adjusted under 35 U.S.C. 154(b) by 0 days.

(21) Appl. No.: 09/682,586

(22) Filed: Sep. 24, 2001

(65) Prior Publication Data

US 2002/0112818 A1 Aug. 22, 2002

Related U.S. Application Data

(62) Division of application No. 09/559,875, filed on Apr. 25, 2000, now Pat. No. 6,332,945.

(51) Int. Cl.[7] ..... A63B 53/02; B23Q 3/00

(52) U.S. Cl. ..... 156/423; 156/556; 156/578; 29/281.1

(58) Field of Search ..... 156/423, 556, 156/578; 473/305, 311, 314, 409; 29/281.1

(56) References Cited

U.S. PATENT DOCUMENTS

| | | | | |
|---|---|---|---|---|
| 4,869,304 | A | 9/1989 | Gore | 144/354 |
| 5,240,252 | A | 8/1993 | Schmidt et al. | 473/327 |
| 5,771,552 | A | 6/1998 | Karner et al. | 29/407.1 |
| 5,931,742 | A | 8/1999 | Nishimura et al. | 473/305 |
| 6,146,286 | A | 11/2000 | Masuda | 473/305 |
| 6,245,178 | B1 * | 6/2001 | Lenhof et al. | 156/187 |

* cited by examiner

*Primary Examiner*—Michael W. Ball
*Assistant Examiner*—Todd J. Kilkenny
(74) *Attorney, Agent, or Firm*—Michael A. Catania

(57) ABSTRACT

The method and apparatus of the present invention includes an alignment base for receiving a golf club head, an injector for injecting an adhesive material into a bore of the golf club head, and a rotating mechanism for holding and rotating a shaft for attachment to the golf club head. The present invention allows for greater efficiency in the amount of adhesive material that is used to attach the shaft to the golf club head, and reduces the assembly time.

10 Claims, 13 Drawing Sheets

APPARATUS FOR ASSEMBLING A SHAFT TO A GOLF CLUB HEAD

CROSS REFERENCE TO RELATED APPLICATIONS

The present application is a divisional application of U.S. patent application Ser. No. 09/559,875, now U.S. Pat. No. 6,332,945 B1 which was filed on Apr. 25, 2000.

FEDERAL RESEARCH STATEMENT

Not Applicable

BACKGROUND OF INVENTION

1. Field of the Invention

The present invention relates to assembling shafts to golf club heads. More specifically, the present invention relates to a method and an apparatus for automatically assembling a shaft to a golf club head.

2. Description of the Related Art

The game of golf has benefited greatly from technological advancements throughout its glorious history. Examples include the progression of golf ball from a leather featherie version to the gutta percha version to the dimpled version to the two-piece and three piece versions of today. Another example of the technological advancement of golf is the progression of the shaft from wood to metal to graphite to the hybrid versions of today. Yet another example of the technological advancement of golf is the progression of woods from persimmon to steel to titanium to the advanced materials of today. All of these advancements have greatly improved the game of golf for golfers everywhere. However, the game of golf still requires a shaft connected to a golf club head in order to strike a golf ball.

The attachment of the shaft to the golf club head requires securing the shaft to the golf club head in a manner that withstands the tremendous forces exerted during swinging and impact with a golf ball. The attachment mechanism could encompass compressive forces, chemical adhesion and/or mechanical means. One preferred manner for attaching a shaft to a metal wood has been the use of an epoxy to secure the shaft within a hosel. This attachment procedure is usually performed manually, with an operator overcoating a tip end of a shaft with epoxy, and then inserting the shaft into the hosel wherein excess epoxy (2 to 4 grams) is flushed onto the golf club head. This procedure is wasteful and detrimental to the operator if performed continuously throughout the day.

SUMMARY OF INVENTION

The present invention provides a solution to the wastefulness and other problems of attaching a shaft to a golf club head. The present invention is able to accomplish this by providing a method and apparatus that automates most of the procedure thereby eliminating the wastefulness and reducing production time while making the procedure easier for an operator.

One aspect of the present invention is an apparatus for assembling a shaft to a golf club head. The golf club head has a bore therethrough with a crown opening and a sole opening. The shaft has a tip end and a butt end. The apparatus includes a frame, an alignment base, an injector, a rotator and a plunger. The frame has an upper section and a lower section. The alignment base is disposed on a lower section of the frame and has a recess generally configured to receive the golf club. The recess has an aperture therethrough. The injector is aligned with the aperture of the recess of the alignment base and is capable of oscillation along a path through the aperture. The rotator is disposed on the upper section of the frame for holding and rotating the shaft. The plunger moves the shaft through the bore of the golf club head.

Another aspect of the present invention is a method for assembling a shaft to a golf club head. The golf club head has a bore therethrough with a crown opening and a sole opening. The shaft has a tip end and a butt end. The method includes positioning the golf club head in an alignment base with the sole opening aligning with an aperture in the alignment base. Next, an injector nozzle is positioned in the bore of the golf club head through the aperture in the alignment base and through the sole opening of the bore of the golf club head. Next, the tip end of the shaft positioned into the bore of the golf club head through the crown opening. The pressure of the shaft expands a multiple of O-rings on the nozzle thereby creating a sealed area about the nozzle within the bore. Next, an adhesive material is injected from the injector nozzle into the bore of the golf club head. Next, the shaft is rotated within the bore of the golf club head to enter the sealed area and to disperse the adhesive material. Next, the shaft is moved further into the bore of the golf club head to remove the nozzle from the bore of the golf club head.

Yet another aspect of the present invention is an apparatus for assembling a shaft to a golf club head having a bore therethrough with a crown opening and a sole opening. The shaft has a tip end and a butt end. The apparatus includes a frame, a plurality of interchangeable alignment bases, an injector, a rotator and a plunger. The frame has an upper section, a lower section and a lateral extension. Each of the plurality of interchangeable alignment bases has a recess generally configured to receive a specific golf club head. The recess of each of the plurality of interchangeable alignment bases has an aperture therethrough. Each of the plurality of interchangeable alignment bases is substitutable within the lateral extension. The injector is disposed on the lower section of the frame and is capable of oscillation along a longitudinal path. The rotator is disposed on the upper section of the frame for holding and rotating the shaft. The plunger moves the shaft through the bore of the golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
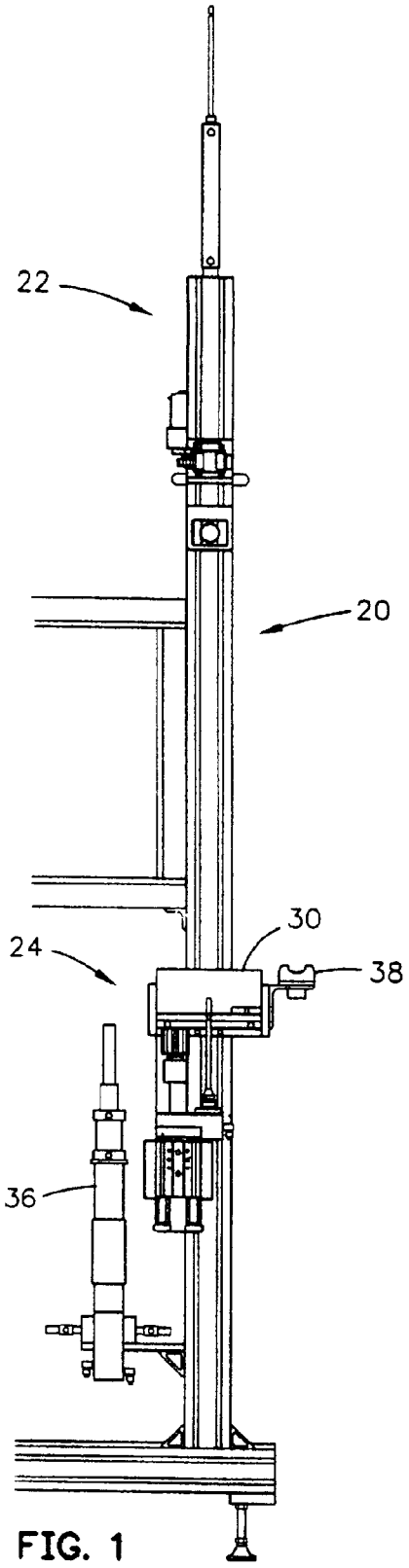
FIG. 1 is a front view of the apparatus of the present invention.
Figure 2:
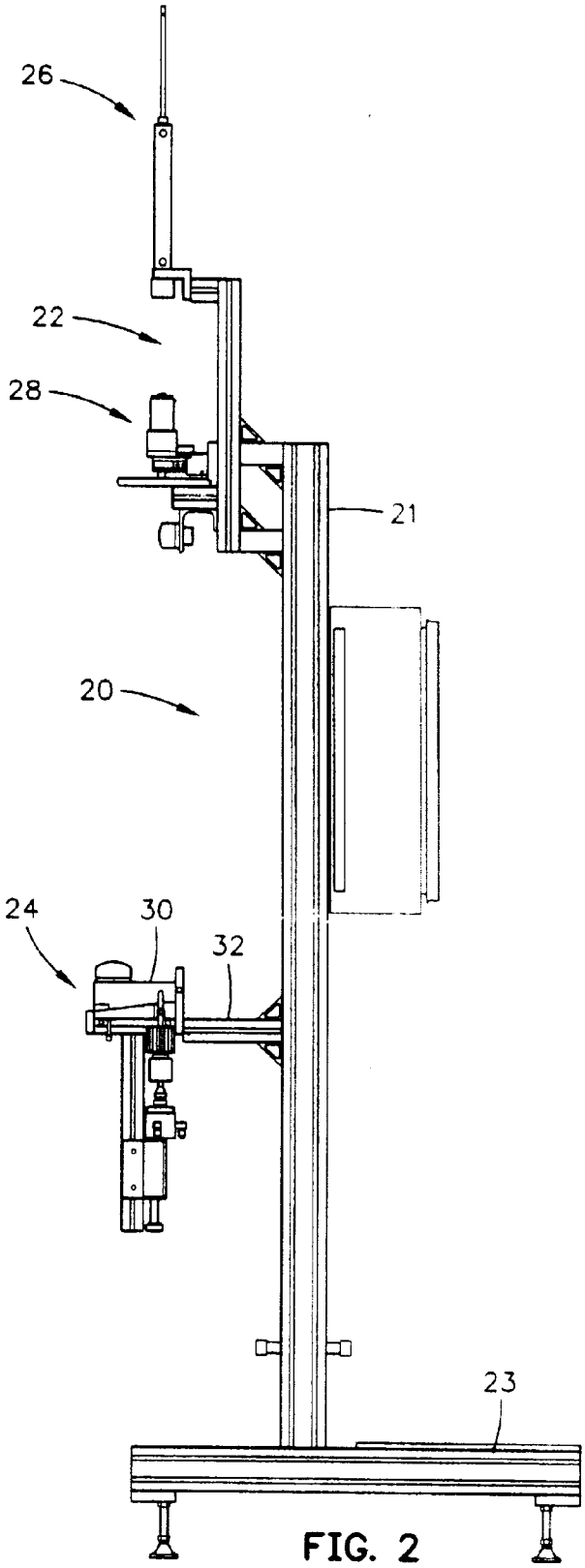
FIG. 2 is a side view of the apparatus of FIG. 1.

As shown in FIGS. 1 and 2, the apparatus of the present invention is generally designated 20. The apparatus 20 has an upper section 22 and a lower section 24. A frame 21 of the apparatus is attached to a base 23. A plunger 26 is mounted on the frame 21 in the upper section 22 of the apparatus 20. A rotator 28 is also mounted on the frame 21 in the upper section 22. The operations of the rotator 28 and plunger 26 will be described in greater detail below.

An alignment base 30 is disposed on a lateral extension 32 of the frame 21 in the lower section 24 of the apparatus 20. An injector 34 is mounted below the alignment base 30. A pump 36 is also mounted on the frame 21 in the lower section 24. A control actuator sensor 38 is also mounted on the frame 21 in the lower section 24. The operations in the lower section 24 will be described in greater detail below.

Figure 3:
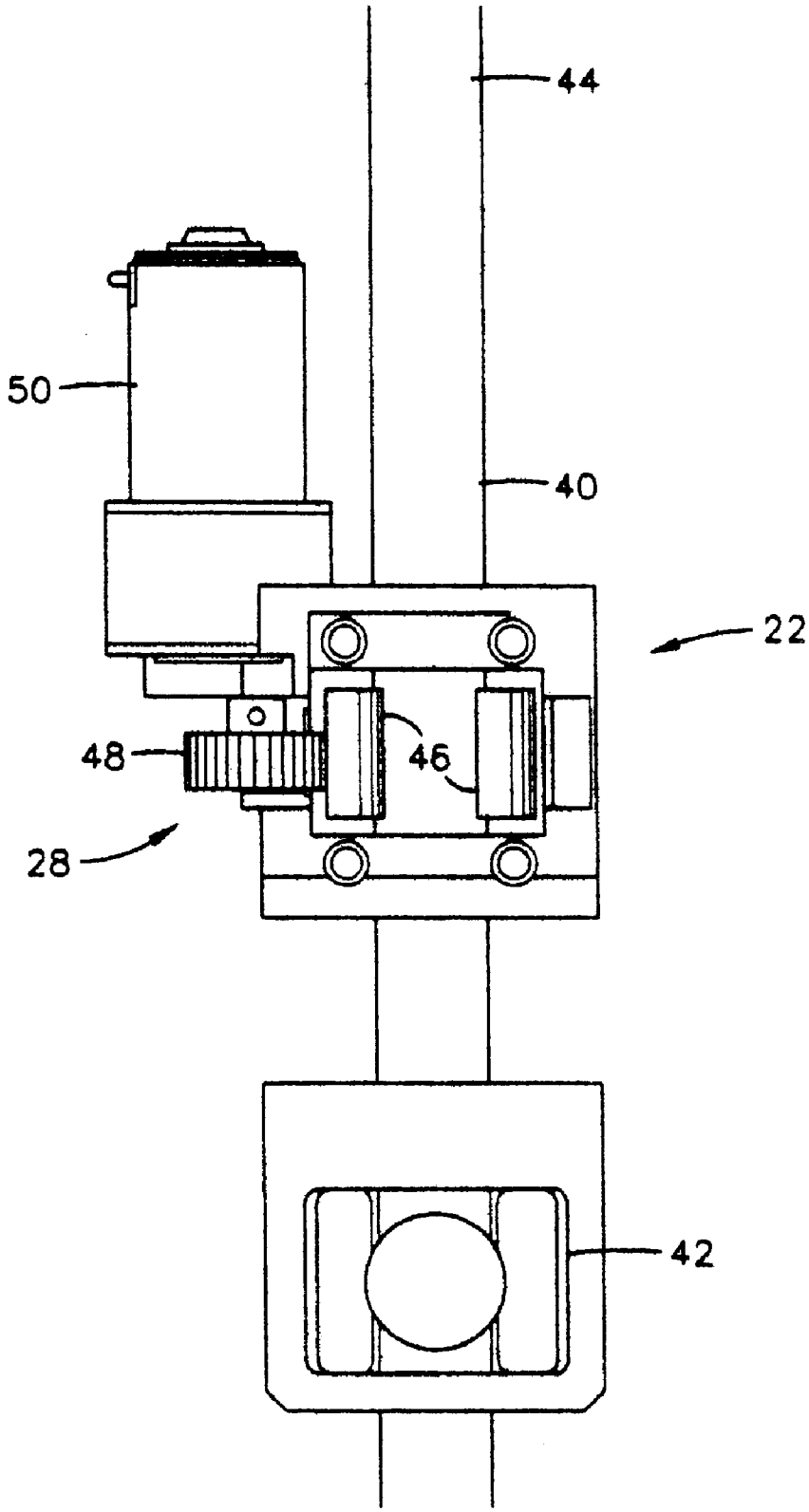
FIG. 3 is an isolated front view of an upper portion of the apparatus of the present invention.

The rotator 28 is shown in greater detail in FIG. 3. The rotator 28 receives a shaft 40 nearest its butt end 44. The shaft 40 is positioned within the rotator 28 and a shaft positioning sensor 42. A plurality of rollers 46 of the rotator 28 hold the shaft 40 in place and also rotate the shaft 40 during the assembly process. At least one of the rollers 46 is connected to a gear 48 that is itself connected to a motor 50. The motor 50 may be a servomotor, step motor, or the like. The length of the frame 21 and the distance between the alignment base 30 and the rotator 28 are dependent on the length of the shaft 40.

Figure 4:
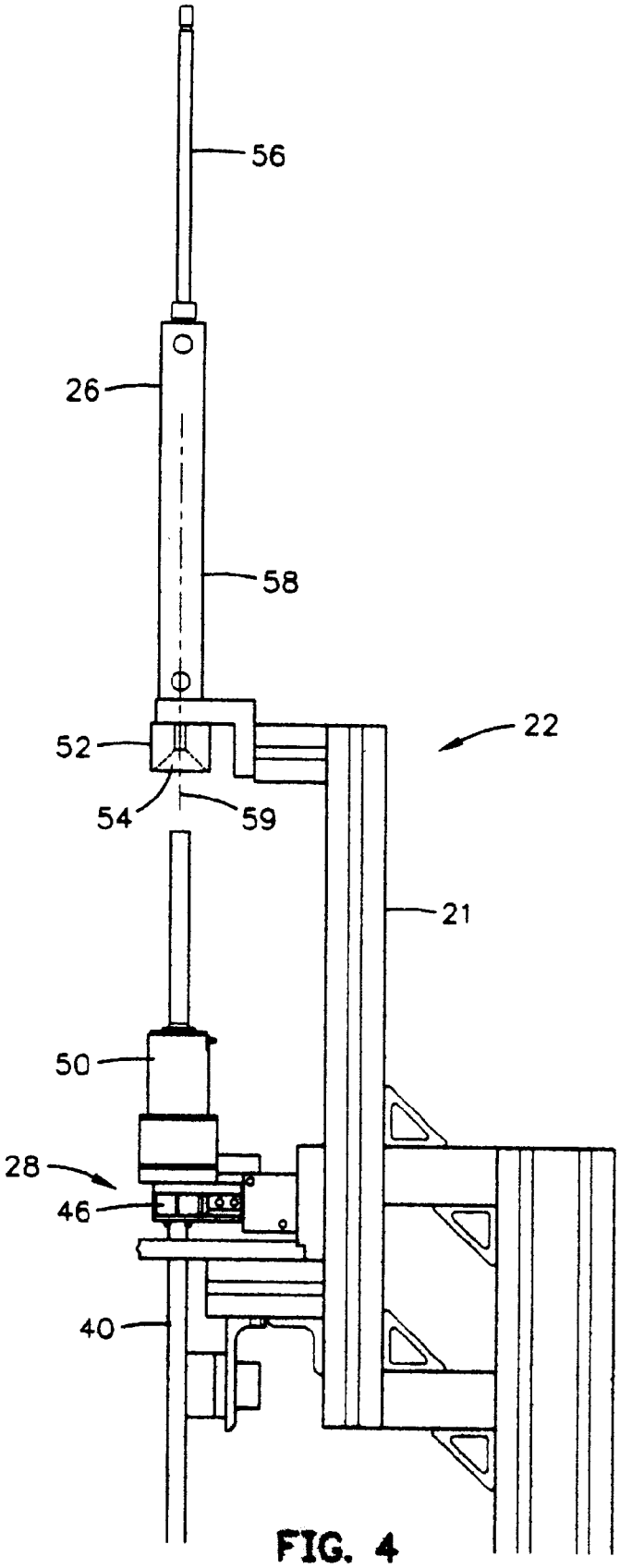
FIG. 4 is a side view of the upper portion of the apparatus of the present invention.

The plunger 26 is shown in greater detail in FIG. 4. The plunger 26 is composed of a shaft engagement member 52 that has a recess 54, and a rod 56 that is connected to a drive mechanism 58. The drive mechanism 58 is preferably a pneumatic cylinder, however, other means may be utilized to drive the rod 56 such as a servomotor or a stepper motor. The plunger 26 oscillates along longitudinal path 59 that is in alignment with the shaft 40 when the shaft 40 is placed within the plurality of rollers 46. During the assembly operation, the recess 54 of the shaft engagement member 52 of the plunger 26 will engage the butt end 44 of the shaft 40. The drive mechanism 58 lowers the rod 56 along the longitudinal path 59 to plunge the shaft 40 into a golf club head 60, not shown. Once the shaft 40 is lowered, the drive mechanism 58 completes the oscillation by raising the rod 56 to an initial staging position.

Figure 5:
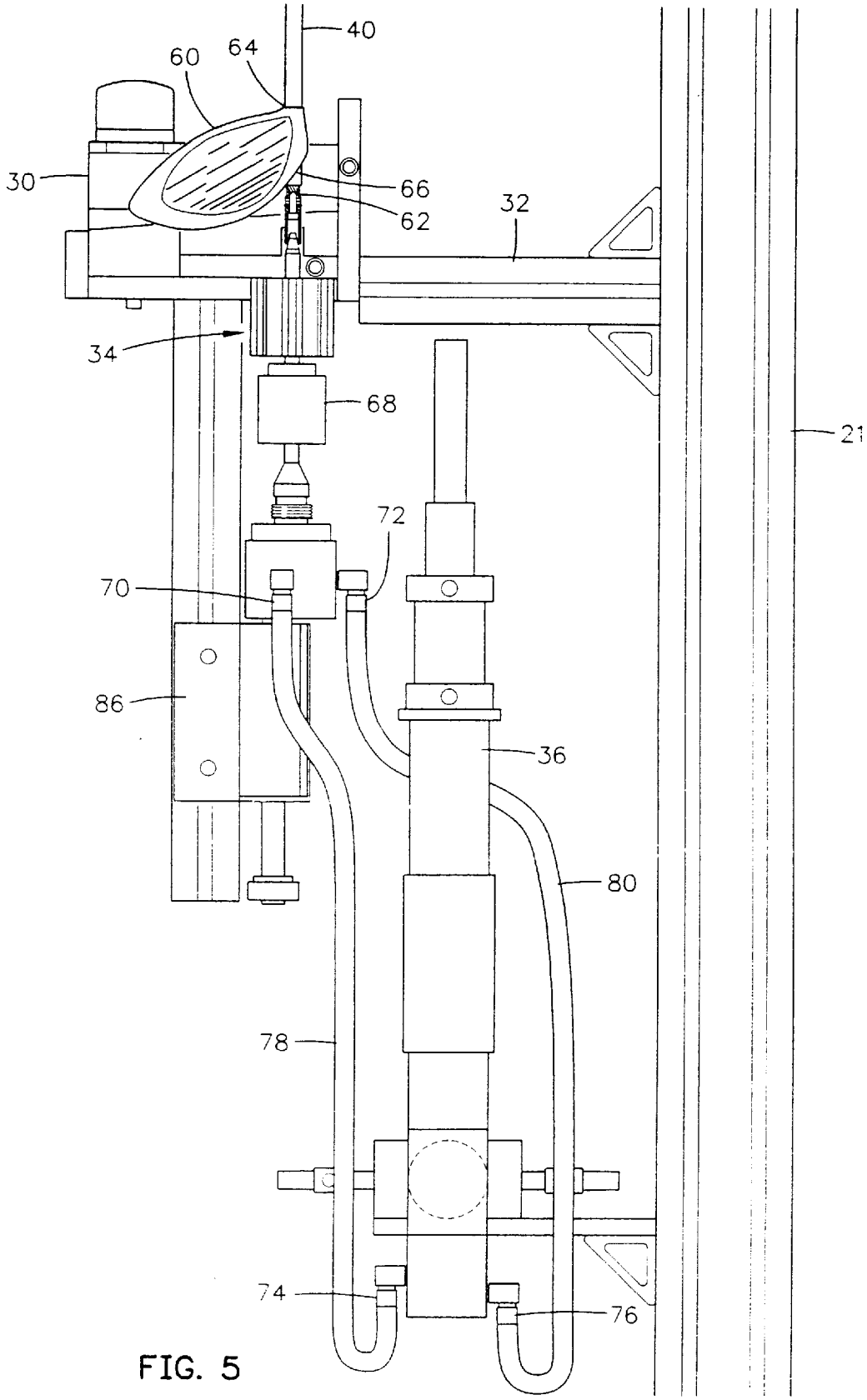
FIG. 5 is a side view of a lower portion of the apparatus of the present invention.
Figure 6:
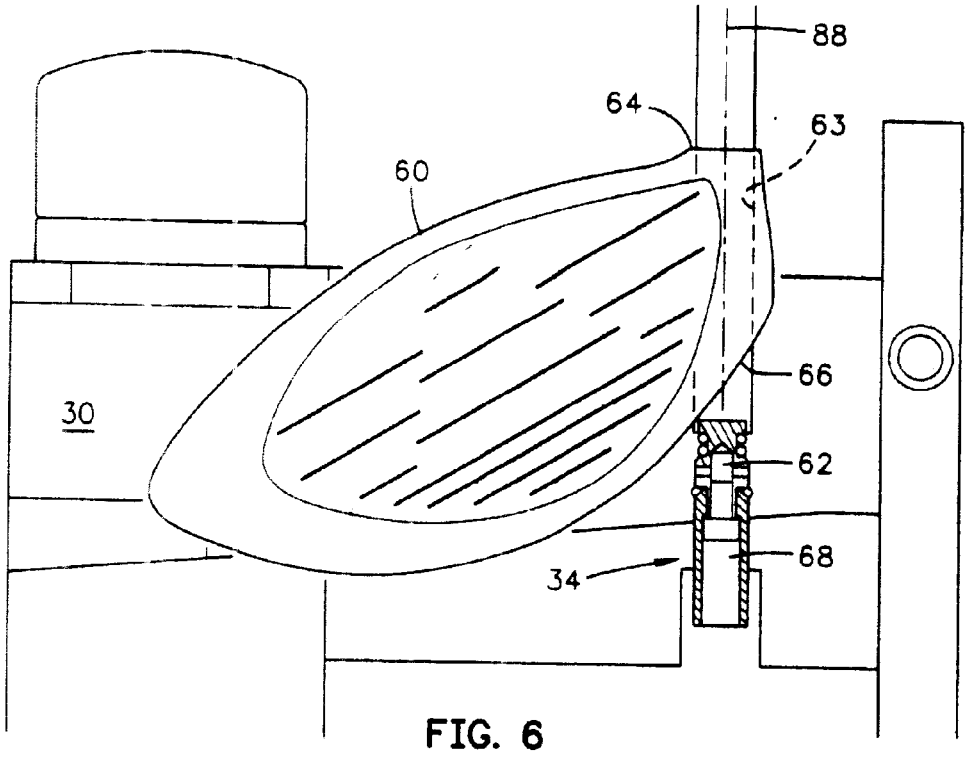
FIG. 6 is an isolated view of a golf club head positioned on the apparatus of the present invention.

The lower section 24 of the apparatus 20 is shown in greater detail in FIG. 5. A golf club head 60 is positioned within the alignment base 30 during the assembly process to receive an injector nozzle 62 of the injector 34. The nozzle 62 enters a bore 63 of the golf club head through a sole opening 66. The bore 63 is preferably an internal hosel for the golf club head 60. The shaft 40 is positioned through a crown opening 64 of the bore. As shown in FIG. 6, the golf club head 60 is preferably neckless, however, those skilled in the pertinent art will recognize that external hosel golf club heads are well within the scope and spirit of the present invention. One example of such a golf club head 60 is the GREAT BIG BERTHA® HAWK EYE® titanium driver available from the Callaway Golf Company of Carlsbad, Calif.

The injector nozzle 62 is in flow communication with a tube flow chamber 68 in which the precursor adhesive materials are mixed prior to injection into the bore 63. A pair of tubes 78 and 80 are connected between inlets 70 and 72 and outlets 74 and 76. The outlets 74 and 76 are in flow communication with sources of the precursor adhesive materials 82 and 84, not shown. In a preferred embodiment, the-adhesive material 100 is an epoxy such as 9P460 from the 3M Company, and the precursor materials 82 and 84 are a resin and an accelerator. The adhesive material 100 is separated into precursor components to prevent clogging of the flow of adhesive material 100 to the injector nozzle 62. The precursor adhesive materials 82 and 84 are pumped into the injector 34 by the pump 36. Any conventional pump may be used in practicing the present invention. The precursor materials 82 and 84 are pumped into the nozzle 62 as the nozzle is raised by a drive mechanism 86 along a longitudinal path 88 into the sole opening 66 of the bore 63. The drive mechanism 86 may be a servomotor, step motor, or the like.

Figure 7:
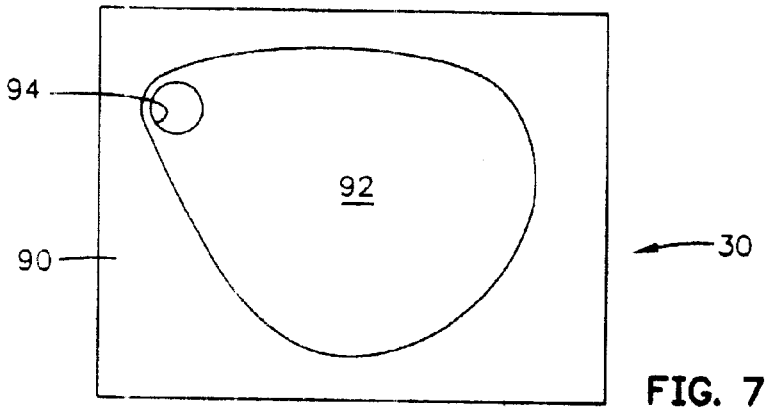
FIG. 7 is an isolated top plan view of an alignment base of the present invention.
Figure 8:
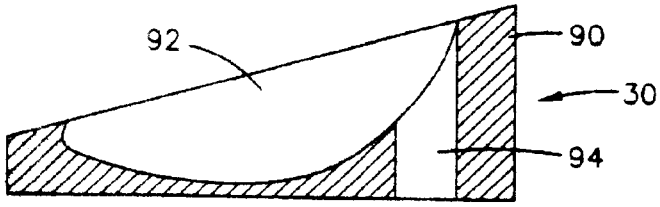
FIG. 8 a cross-sectional view of the alignment base of FIG. 7.

The alignment base 30 is shown in greater detail in FIGS. 7 and 8. The alignment base 30 is removable from the apparatus 20, and in a preferred embodiment a plurality of alignment bases 30 are utilized in the assembly process. The alignment base 30 has a body 90 that is preferably square, however, those skilled in the relevant art will recognize that any shape may be utilized without departing from the scope and spirit of the present invention. The body has a recess 92 that is configured to receive a golf club head 60, and the recess 92 has an aperture 94 therethrough for insertion of the injector nozzle 62. The recess 92 corresponds to the loft and lie of the golf club head 60. Thus, each loft of a golf club head 60 preferably has its own alignment base 30 with a recess 92 configured to receive that particular golf club head 60. For example, a driver that is available in 9 degrees, ten degrees, eleven degrees and twelve degrees would preferably have four different alignment bases 30. Although not shown, those skilled in the art will recognize that the alignment base 30 could be configured to receive an iron golf club head or a putter golf club head without departing from the scope and spirit of the present invention.

Figure 9:
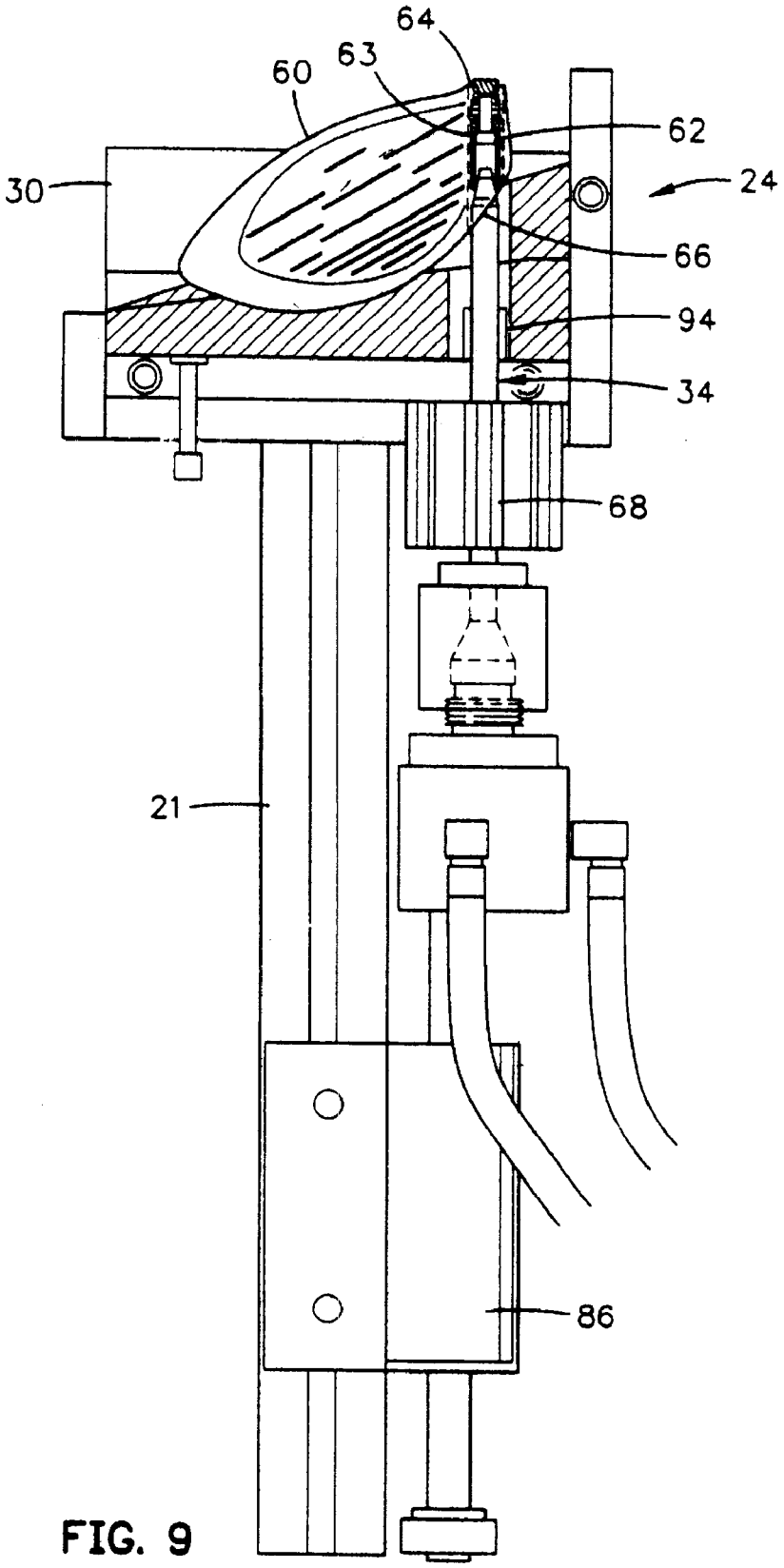
FIG. 9 is a side view of one step of the assembling process wherein an injector nozzle of the present invention is disposed within a golf club head.
Figure 10:
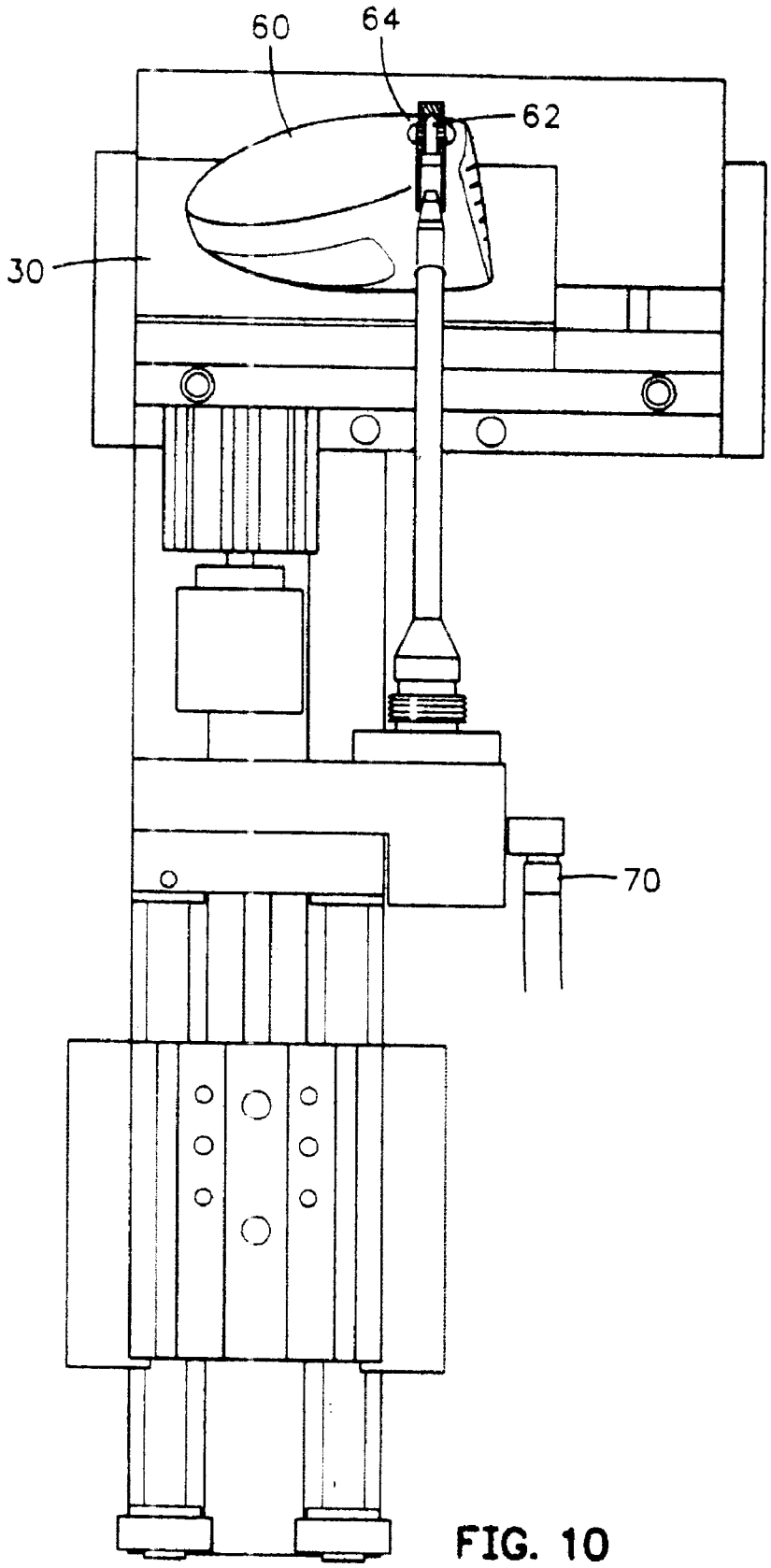
FIG. 10 is a front view of FIG. 9.

FIGS. 9–14 illustrate the assembly process for attaching a shaft 40 to a golf club head 60 using the apparatus 20 of the present invention. FIGS. 9 and 10 illustrate the insertion of the nozzle 62 into the bore 63 of the golf club head 60. The golf club head 60 has been placed into the recess 92 of the alignment base, and aligned such that the bore 63 is aligned with the aperture 94. The nozzle 62 is inserted into the bore through the aperture 94 and the sole opening 66. The nozzle 62 does not occupy the entire volume of the bore 63 thereby allowing for the adhesive material 100 to occupy space within the bore 63. The nozzle 63 may have a plurality of injection ports 109 for dispersion of the adhesive material 100 within the bore 63.

Figure 11:
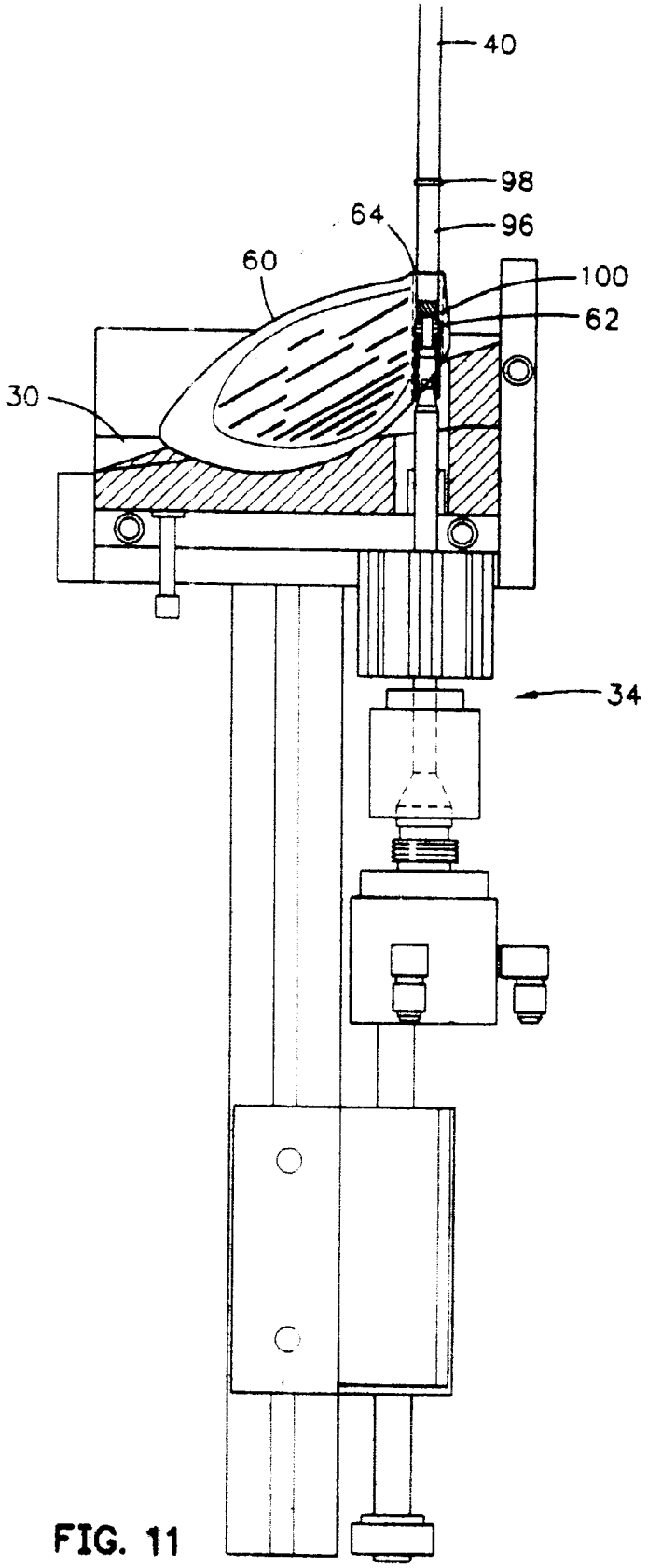
FIG. 11 is a side view of a second step of the assembling process wherein the injector nozzle and a shaft are disposed within the golf club head.
Figure 12:
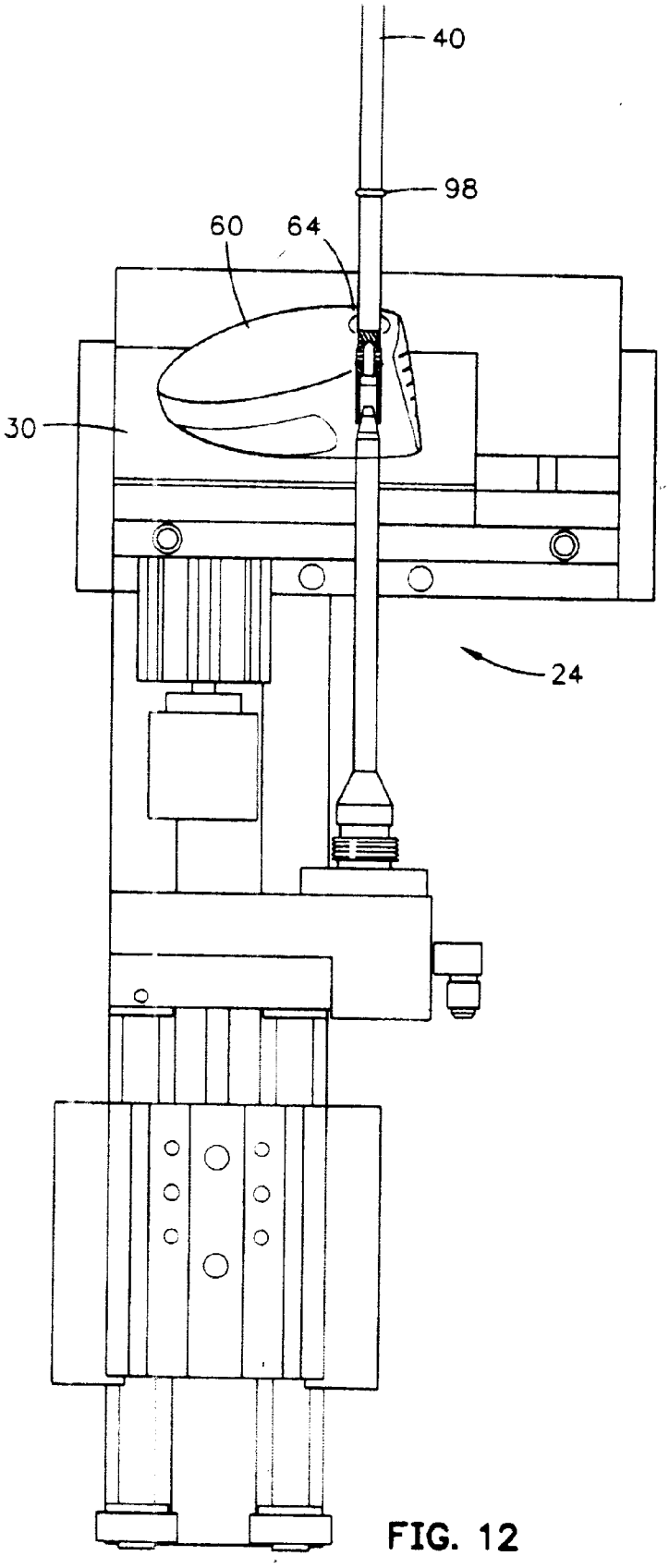
FIG. 12 is a front view of FIG. 11.

As shown in FIGS. 11 and 12, the shaft 40 is placed into the crown opening 64 and also placed within the plurality of rollers 46. The shaft 40 is placed on the nozzle 62 within the bore 63. The tip end 96 of the shaft 40 engages the nozzle 62 as explained in greater detail in reference to FIGS. 15–18. After the shaft 40 engages the nozzle 62, the nozzle 62 injects a predetermined quantity of the adhesive material 100 into the bore 63. Preferably, the predetermined amount of adhesive material 100 ranges from 0.2 to 0.6 grams. This amount is quite less than the prior art process that used between 2 to 4 grams of adhesive material.

The adhesive material 100 is also within the bore 63 and it covers the tip end 96 of the shaft 40 and the walls of the bore 63. The shaft 40 is rotated within the bore 63 by the rotator 28. The shaft 40 is preferably rotated at least one 360 degree rotation. However, the shaft 40 may undergo two or three 360 degree rotations to disperse the adhesive material 100.

Figure 13:
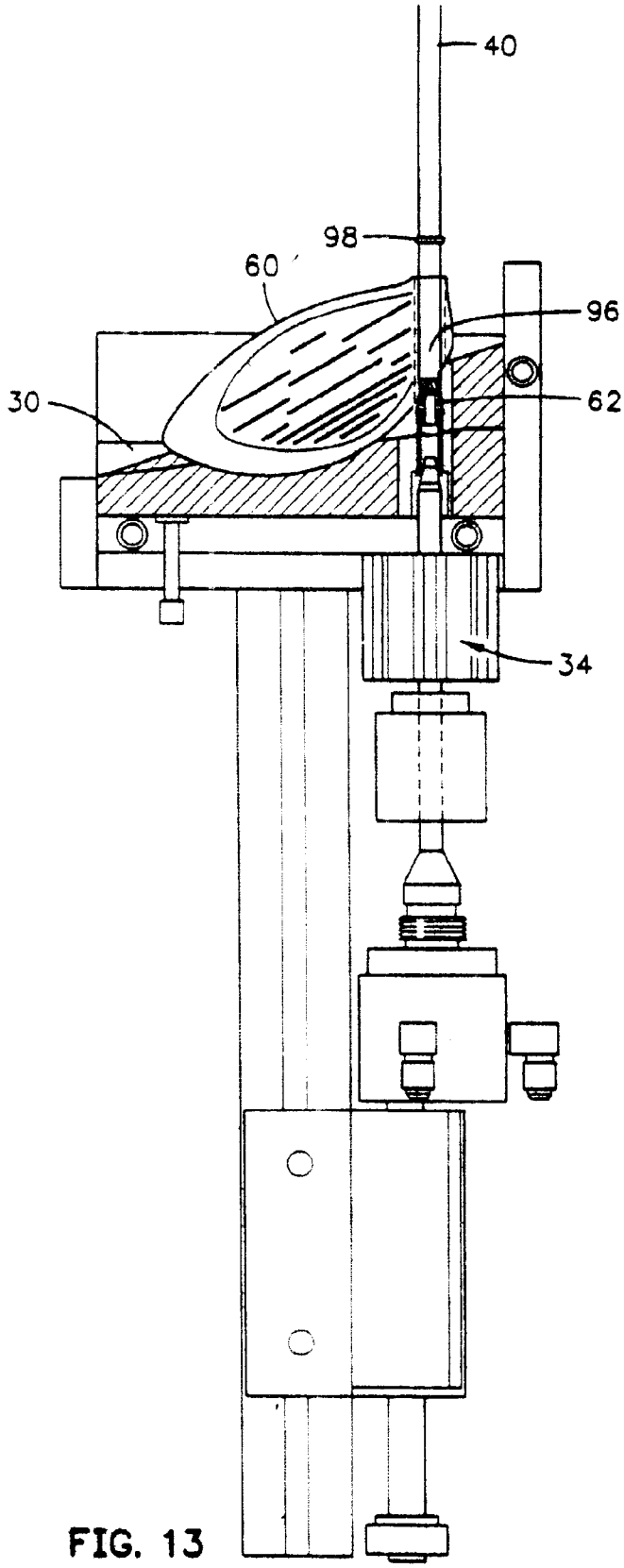
FIG. 13 is a side view of a third step of the assembling process wherein the injector nozzle has been removed while the shaft is maintained within the golf club head.
Figure 14:
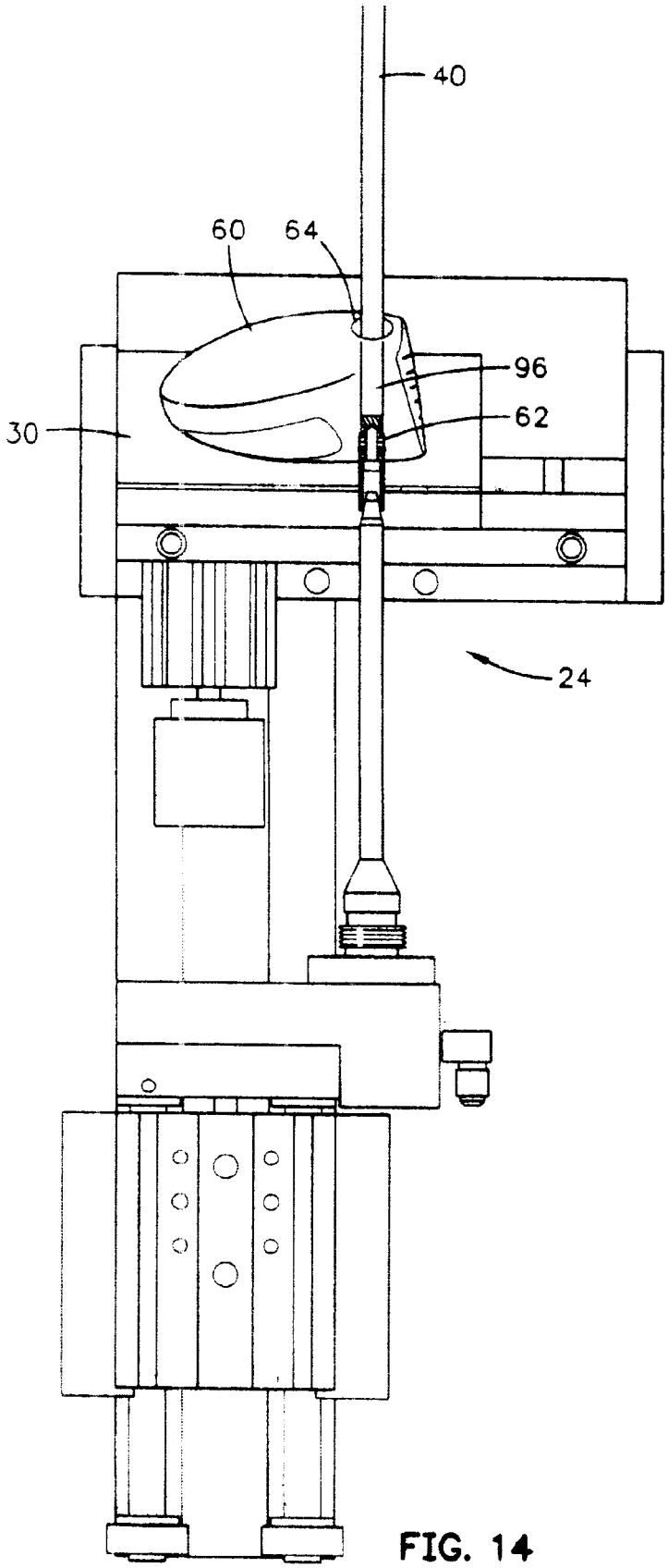
FIG. 14 is a front view of FIG. 11.

As shown in FIGS. 13 and 14, the nozzle 62 is removed from the bore 63 through the sole opening 66. The plunger 26 pushes the shaft 40 further into the bore 63, and preferably through the sole opening 66. The pressure of the plunger 26 forces the nozzle 62 from the bore 63 until the nozzle 62 reaches a point where an actuator signals the drive mechanism 86 to lower the nozzle 62. A torus 98 may be used as a limiting device to prevent the shaft 40 from being inserted too far into the bore 63. The torus 98 will limit the insertion of the shaft 40 through the bore 63. The tip end 96 of the shaft 40 that extends beyond the sole opening 66 and will be removed during further processing on the golf club head 60.

Figure 15:
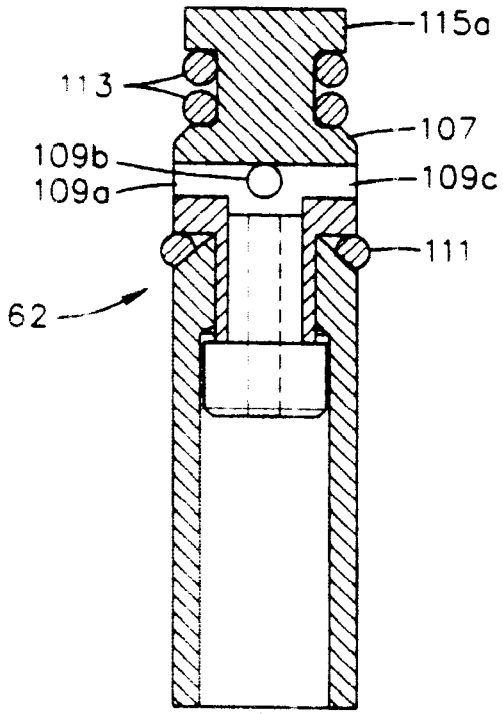
FIG. 15 is an isolated, partial cross-sectional view of the injector nozzle of the present invention.
Figure 16:
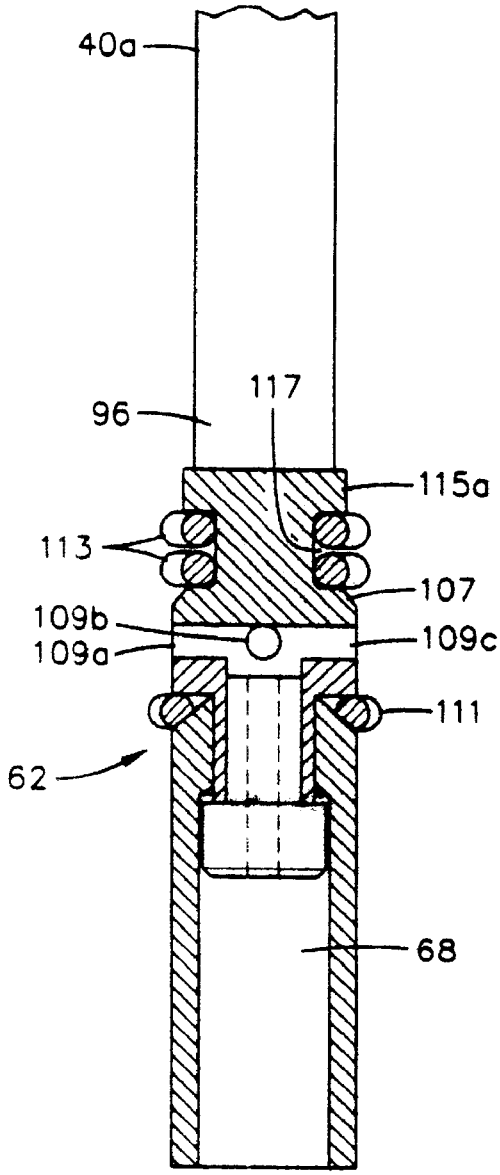
FIG. 16 is an isolated, partial cross-sectional view of the injector nozzle of the present invention engaged with a metal shaft.
Figure 17:
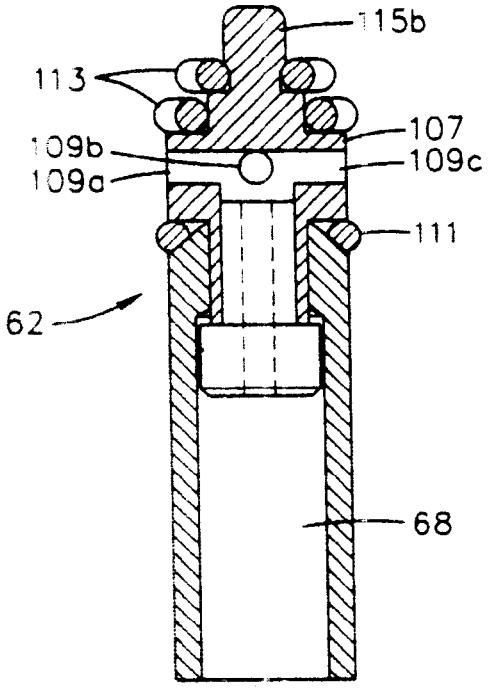
FIG. 17 is an isolated, partial cross-sectional view of an alternative embodiment of the injector nozzle of the present invention.
Figure 18:
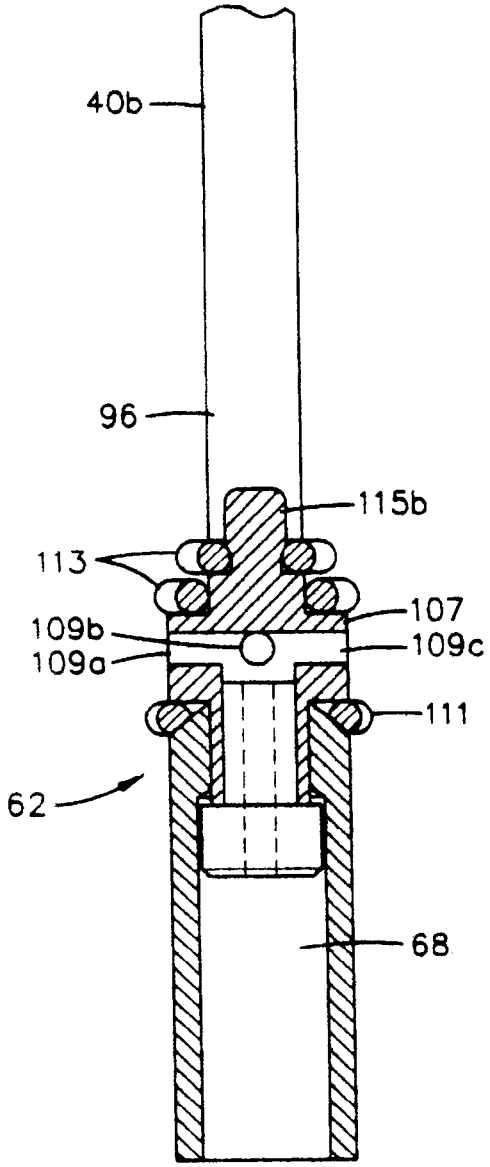
FIG. 18 is an isolated, partial cross-sectional view of the alternative embodiment of the injector nozzle of the present invention engaged with a graphite shaft.

FIGS. 15–18 further illustrate the nozzle 62 of the injector 34 that is used to inject the adhesive material into the bore 63 of the golf club head 60. FIGS. 15 and 16 are directed to an embodiment of the nozzle 62 that is used for shafts 40*a* that are composed of a metal, primarily stainless steel shafts, titanium shafts, hybrid shafts (part metal and part graphite) and the like. FIGS. 17 and 18 are directed to an embodiment of the nozzle 62 that is used for shafts 40*b* composed of graphite. As shown, the nozzle has a body 107 with a plurality of injections ports 109*a–d* (injection port 109*d* is not shown). The number of injection ports 109 may vary from one to ten depending on the size of the ports 109 and their placement on the nozzle 62. The use of four injection ports 109*a–d* is preferred since it enables the adhesive material 100 to be uniformly dispersed within the bore 63.

The nozzle 62 also has at least one lower O-ring 111 and at least one upper O-ring 113. The lower and upper O-rings 111 and 113 prevent leakage of the adhesive material 100 during the assembly process. When the shaft 40*a* or 40*b* is placed on the nozzle 62, as shown in FIGS. 16 and 18, the O-rings 111 and 113 are expanded outward to seal off the bore 63 to prevent leakage of the adhesive material 100. The body 107 of the nozzle has different ends 115*a* and 115*b* depending on the shaft 40*a* or 40*b*. Metal shafts 40*a* typically have a larger tip end diameter and thus the end 115*a* of the body 107 has an I-shape with an undercut 117 for placement of the O-rings 113 therein. Graphite shafts 40*b* typically have a smaller diameter and thus the end 115*b* of the body 107 has a projection with the O-rings 113 placed around it. Those skilled in the art will recognize that the number of O-rings may vary without departing from the scope and spirit of the present invention. Once the shaft 40 is rotated for adherence of the adhesive material 100 thereto and to break the seal of the upper O-rings 113, the plunger 26 forces the nozzle 62 out of the bore 63, even if the O-rings 111 and 113 are expanded and sealing the bore 63 to prevent leakage. Thus, the shaft 40 is attached to the golf club head 60 and the apparatus 20 is readied for the next shaft 40 and golf club head 60.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An apparatus for assembling a shaft to a golf club head, the golf club head having a bore therethrough with a crown opening and a sole opening, the shaft having a tip end and a butt end, the apparatus comprising:

a frame having an upper section and a lower section;

an alignment base disposed on a lower section of the frame and having a recess generally configured to receive the golf club head, the recess having an aperture therethrough;

an injector aligned with the aperture of the recess of the alignment base, the injector capable of oscillation along a path through the aperture, and a source of adhesive materials in flow communication with the injector;

a rotator disposed on the upper section of the frame for holding and rotating the shaft; and a plunger for moving the shaft through the bore of the golf club head.

2. The apparatus according to claim 1 wherein the alignment base is disposed on a lateral extension of the frame and is substitutable for an alignment base according to the golf club head.

3. The apparatus according to claim 1 wherein the rotator comprises a plurality of rollers disposed for receiving the shaft in alignment with the bore of the golf club head, and a motor for rotating the plurality of rollers.

4. The apparatus according to claim 1 wherein the source of adhesive materials comprises a plurality of sources of precursor adhesive materials that are mixed within the injector.

5. The apparatus according to claim 1 wherein the injector further comprises a plurality of O-rings for preventing leakage of the adhesive material.

6. The apparatus according to claim 1 wherein the plunger comprises a shaft engagement member having a recess therein, a rod attached to the shaft engagement member and a drive mechanism connected to the rod to oscillate the rod along a path.

7. The apparatus according to claim 1 wherein the injector comprises a nozzle, means for oscillating the nozzle along a path through the bore of the golf club head, and a plurality of tubes connected to corresponding sources of precursor adhesive materials.

8. An apparatus for assembling a shaft to a golf club head, the golf club head having a bore therethrough with a crown opening and a sole opening, the shaft having a tip end and a butt end, the apparatus comprising:

a frame having an upper section, a lower section and a lateral extension;

a plurality of alignment bases, each having a recess generally configured to receive a specific golf club head, the recess of each of the plurality of alignment bases having an aperture therethrough, each of the plurality of alignment bases substitutable within the lateral extension;

an injector disposed on the lower section of the frame, the injector capable of oscillation along a longitudinal path and a source of adhesive materials in flow communication with the injector;

a rotator disposed on the upper section of the frame for holding and rotating the shaft; and a plunger for moving the shaft through the bore of the golf club head.

9. The apparatus according to claim 8 wherein the plurality of alignment bases comprises a plurality of alignment bases having recesses configured for woods, a plurality of alignment bases having recesses configured for irons, and a plurality of alignment bases having recesses configured for putters.

10. The apparatus according to claim 8 wherein the injector further comprises a plurality of O-rings for preventing leakage of the adhesive material.

* * * * *